US009991593B1

(12) United States Patent
Hill et al.

(10) Patent No.: US 9,991,593 B1
(45) Date of Patent: Jun. 5, 2018

(54) OPTICALLY CONTROLLED ELECTRONICALLY SCANNED ARRAY

(71) Applicants: Adrian A. Hill, Vinton, IA (US); Jeremiah D. Wolf, Marion, IA (US); Bryan S. McCoy, Cedar Rapids, IA (US); Michael C. Meholensky, Marion, IA (US); Anders P. Walker, Marion, IA (US)

(72) Inventors: Adrian A. Hill, Vinton, IA (US); Jeremiah D. Wolf, Marion, IA (US); Bryan S. McCoy, Cedar Rapids, IA (US); Michael C. Meholensky, Marion, IA (US); Anders P. Walker, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 640 days.

(21) Appl. No.: 14/577,546

(22) Filed: Dec. 19, 2014

(51) Int. Cl.
*H01Q 3/26* (2006.01)

(52) U.S. Cl.
CPC ..... *H01Q 3/2676* (2013.01)

(58) Field of Classification Search
CPC ..... H01Q 3/26; H01Q 3/2676
USPC ..... 342/368, 372; 398/115
See application file for complete search history.

(56) References Cited

U.S. PATENT DOCUMENTS 4,689,721 A * 8/1987 Damerow ..... H01R 23/70 361/707
4,814,773 A * 3/1989 Wechsberg ..... H01Q 3/2676 342/368
5,247,310 A * 9/1993 Waters ..... H01Q 3/22 342/368
5,818,386 A * 10/1998 Belisle ..... H01Q 3/26 342/157
7,391,367 B2 * 6/2008 Newberg ..... H01Q 3/2676 342/375
7,898,464 B1 * 3/2011 Anderson ..... H01Q 3/2676 342/175
9,496,610 B2 * 11/2016 Blech ..... H01P 1/182
2003/0202744 A1 * 10/2003 Nunnally ..... H01L 27/14658 385/30
2004/0179779 A1 * 9/2004 Greiner ..... G02B 6/12023 385/37

* cited by examiner

*Primary Examiner* — Harry K Liu
(74) *Attorney, Agent, or Firm* — Angel N. Gerdzhikov; Donna P. Suchy; Daniel M. Barbieri

(57) ABSTRACT

An Electronically Scanned Array (ESA) antenna is controlled via an optical domain without electrical conductors on the ESA Printed Wiring Board (PWB). Distribution of the control signal occurs over pulses of light through an optical medium separate from the ESA PWB. External to the ESA PWB are one or more optical wave guides functional as communications channels which connect the ESA optical receivers/transceivers with transmitters/transceivers interfaced to a system controller. The ESA is divided into groups of elements with serial busses and discrete signals driven by local controllers. The local controller for each group of elements may include one or more optical receivers (unidirectional) or transceivers (bidirectional). This concept offers a trade in electrical complexity associated with an ESA PWB for an additional manufactured medium redundantly supplying the control signal to the ESA as well as routing the RF data signal from the ESA to the system controller.

8 Claims, 10 Drawing Sheets

OPTICALLY CONTROLLED ELECTRONICALLY SCANNED ARRAY

FIELD OF THE INVENTION

Embodiments of the inventive concepts disclosed herein relate generally to control and operation of electronically scanned array antenna elements. More particularly, embodiments of the inventive concepts disclosed herein relate to a system and related method for optical control and operation of an electronically scanned array antenna.

BACKGROUND

Current Electronically Scanned Array (ESA) antenna technology may build an array of elements on a single Printed Wiring Board (PWB). Each element in an ESA panel must be properly controlled in phase and attenuation to correctly form the beam and accurately steer the beam to a desired azimuth and elevation relative to the ESA panel. Each of the controllable ESA elements requires proper control signals to direct the ESA elements to act in concert for proper operation. Traditional ESA control circuits may employ a Radio Frequency Integrated Circuit (RFIC) associated with a Serial Peripheral Interface (SPI) control bus to provide a microcontroller derived electrical signaling using four lines: 1) clock line, 2) data input, 3) data output and 4) chip select.

For fault tolerance and reliability, there is traditionally a plurality of redundant and bulky serial busses built into the PWB to control the array of ESA elements. Typical implementations may include at least one unique serial bus for each row and another unique serial bus for each column of elements on the array. To increase reliability, redundant and expensive serial busses may be traditionally employed to control the column or row of ESA elements should one SPI control bus fail. In addition, any digital bus associated with an ESA array may be subject to damage and failure, the loss of which may render the entire ESA inoperative.

As array size increases, the number of traditional control serial busses (each consisting of 3-4 signals) also increases by the number of rows multiplied by the number of columns. As the number of signals increases, routing design becomes more complex, fan out traces increase in size and number and unit costs rise significantly. Additionally, interfacing the array to a large number of serial busses may require an expensive number of Field Programmable Gate Array (FPGA) components resulting in a large physical package with associated supporting components.

Therefore, a need remains to solve the problem of increasing matrices of control signals requiring bulky serial busses, numerous fan-out traces and additional cost. A desirable ESA architecture may eliminate these bulky and complex fan-out traces as well as those running the entire length and width of the PWB.

SUMMARY

Embodiments of the inventive concepts disclosed herein are directed to a system for optical control of an electronically scanned array (ESA) antenna. The system may comprise an optical signal transmission medium having a transmission optical interface and an ESA optical interface. The transmission optical interface associated is with a source of an optical control signal and a destination of a Radio Frequency (RF) data signal. The transmission optical interface is also configured for receiving array pointing commands from an operator, translating the array pointing commands from a first medium to an optical control signal, the optical control signal configured for transmission via the optical transmission medium, sending the optical control signal via the at least one optical signal transmission medium to the ESA optical interface. Here, the ESA optical interface is associated with at least one ESA antenna element, the least one ESA antenna element being either a source of the RF data signal and a conduit through which the RF data signal may travel.

The ESA optical interface may have an optical transceiver configured for: receiving the optical control signal from the at least one optical signal transmission medium, translating the optical control signal for use by the at least one ESA antenna element, and transmitting a content of the optical control signal to the at least one ESA antenna element, a system control computer device, a memory associated with the system control computer device, the memory having non-transitory computer readable program code embodied therein, the non-transitory computer readable program code comprising commands which, when executed by the system control computer device, cause the system control computer device to: receive the array pointing commands from the operator, send the array pointing commands to the transmission optical interface, receive the RF data signal, display a content of the RF data signal on a display.

An additional embodiment of the inventive concepts disclosed herein may include a system wherein the at least one optical signal transmission medium further comprises a plurality of row optical wave guides and a plurality of column optical wave guides, the plurality of column optical wave guides perpendicular to the plurality of row optical wave guides, each of the plurality of column and row optical wave guides redundantly deliver the optical control signal to the at least one ESA antenna element.

An additional embodiment of the inventive concepts disclosed herein may include the at least one optical signal transmission medium further comprising a plurality of shapes to redundantly deliver the control signal. The shapes may include a diagonally oriented optical wave guide, a hopscotch oriented optical wave guide, a circularly oriented optical wave guide, a radially oriented optical wave guide and a triangularly oriented optical eave guide to enable triple and quad redundancy of the optical control signal available to the at least one ESA antenna element.

An additional embodiment of the inventive concepts disclosed herein may include a system wherein the at least one optical signal transmission medium is a fiber optic cable configured for a low loss optical signal transmission.

An additional embodiment of the inventive concepts disclosed herein may include a system wherein the source of the optical control signal is a beam steering computer associated with a weather radar system, a radio communication system, and a radio surveillance system, the destination of the RF data signal is an operator radar display, and the source of the RF data signal is external to the at least one ESA antenna element.

An additional embodiment of the inventive concepts disclosed herein may include a system wherein each of the transmission optical interface and the ESA optical interface is further configured for a bi-directional optical data transfer between the at least one ESA antenna element and the system control computer via the optical signal transmission medium.

An additional embodiment of the inventive concepts disclosed herein may include a system wherein the transmission optical interface is further configured for translating the array pointing commands into a plurality of signal control parameters, the plurality of signal control parameters including at least amplification, attenuation and phase shift, for each of the at least one ESA antenna elements.

An additional embodiment of the inventive concepts disclosed herein may include a system wherein the at least one optical transceiver further comprises at least a light emitting diode, a laser diode, a laser, a photo transistor, photo resistor and an optical receiver.

An additional embodiment of the inventive concepts disclosed herein may include a system wherein the content of the optical control signal further includes attenuation commands, phase shift commands and power control commands for each of the at least one ESA antenna element.

An additional embodiment of the inventive concepts disclosed herein may include a system further including a dual printed wiring board assembly associated with the at least one ESA antenna element, the optical signal transmission medium associated with the dual printed wiring board assembly includes a gaseous cavity between a first printed wiring board and a second printed wiring board comprising the dual printed wiring board assembly.

An additional embodiment of the inventive concepts disclosed herein may include a system wherein the RF data signal further includes raw radar returns associated with a desired radar reflective target and a signal associated with a distant radio communication transmitter.

An additional embodiment of the inventive concepts disclosed herein may include a method for optically controlling an Electronically Scanned Array (ESA) antenna, comprising: receiving array pointing commands from an operator, sending the array pointing commands to a transmission optical interface, translating the array pointing commands from a first medium to an optical control signal via the transmission optical interface, the optical control signal configured for transmission via an optical transmission medium, sending the optical control signal via the at least one optical signal transmission medium to an ESA optical interface, translating the optical control signal for use by at least one ESA antenna element, the translating via the ESA optical interface, and sending a content of the optical control signal to the at least one ESA antenna element, the content of the optical control signal commanding at least an attenuation command and a phase shift command for each of the at least one ESA antenna element.

An additional embodiment of the inventive concepts disclosed herein may include a method which includes receiving a RF data signal from the at least one ESA antenna element, translating the RF data signal via the ESA optical interface, sending the RF data signal via the at least one optical signal transmission medium to a transmission optical interface, translating the RF data signal for use by a system control computer via the transmission optical interface, sending a content of the RF data signal to a display readable by the operator displaying the content of the RF data signal on the display.

An additional embodiment of the inventive concepts disclosed herein may include a method wherein sending the optical control signal via the at least one optical signal transmission medium to an ESA optical interface further comprises sending the optical control signal via a plurality of row optical wave guides and a plurality of column optical wave guides, the plurality of column optical wave guides perpendicular to the plurality of row optical wave guides, each of the plurality of column and row optical wave guides redundantly deliver the optical control signal to the at least one ESA antenna element.

An additional embodiment of the inventive concepts disclosed herein may include a method wherein sending the optical control signal via the at least one optical signal transmission medium to an ESA optical interface further includes sending the optical control signal via at least a diagonally oriented optical wave guide, a hopscotch oriented optical wave guide, a circularly oriented optical wave guide, a radially oriented optical wave guide and a triangularly oriented optical eave guide to enable triple and quad redundancy of the optical control signal available to the at least one ESA antenna element.

An additional embodiment of the inventive concepts disclosed herein may include a method wherein sending the optical control signal via the at least one optical signal transmission medium further comprises sending the optical control signal via a fiber optic cable configured for a low loss optical signal transmission.

An additional embodiment of the inventive concepts disclosed herein may include a method further including a bi-directional optical data transfer between the at least one ESA antenna element and the system control computer via the optical signal transmission medium.

An additional embodiment of the inventive concepts disclosed herein may include a method wherein the content of the optical control signal further includes antenna pointing commands for steering an ESA radar beam to a desired direction in azimuth and elevation.

An additional embodiment of the inventive concepts disclosed herein may include a method wherein the RF data signal further includes raw radar returns associated with a desired radar reflective target and a signal associated with a distant radio communication transmitter.

An additional embodiment of the inventive concepts disclosed herein may include a method wherein receiving a RF data signal from the at least one ESA antenna element further includes receiving the RF data signal from a dual printed wiring board assembly associated with the at least one ESA antenna element, the optical signal transmission medium associated with the dual printed wiring board assembly includes a gaseous cavity between a first printed wiring board and a second printed wiring board comprising the dual printed wiring board assembly.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the inventive concepts disclosed herein may be better understood by those skilled in the art by reference to the accompanying figures in which.

DETAILED DESCRIPTION

Reference will now be made in detail to the presently preferred embodiments of the inventive concepts disclosed herein, examples of which are illustrated in the accompanying drawings. The following description presents certain specific embodiments of the inventive concepts disclosed herein. However, the inventive concepts disclosed herein may be embodied in a multitude of different ways as defined and covered by the claims. In this description, reference is made to the drawings wherein like parts are designated with like numerals throughout.

Embodiments of the inventive concepts disclosed herein may provide an ESA controlled via an optical medium without burdensome electrical conductors on the PWB. In this manner, distribution of the control signal occurs over pulses of light through an optical manifold separate from the ESA PWB. External to the ESA PWB and preferably outside a Radio Frequency (RF) shield are one or more optical signal transmission medium (optical wave guides) functional as communications channels which connect the ESA optical receivers/transceivers with transmitters/transceivers interfaced to a system controller. The ESA is divided into small groups of elements with serial busses and discrete signals driven by low-cost local controllers. The local controller for each group of elements may include one or more optical receivers (unidirectional) or transceivers (bidirectional).

One aspect of the inventive concepts disclosed herein may offer a trade in electrical complexity associated with an ESA PWB for an additional manufactured manifold or distribution system to supply the control signal to the ESA. This distribution system may be external to and separate from the circuit board and therefore may offer a reduction in cost of individual components of the ESA and individual components of the support system thereof.

Figure 1:
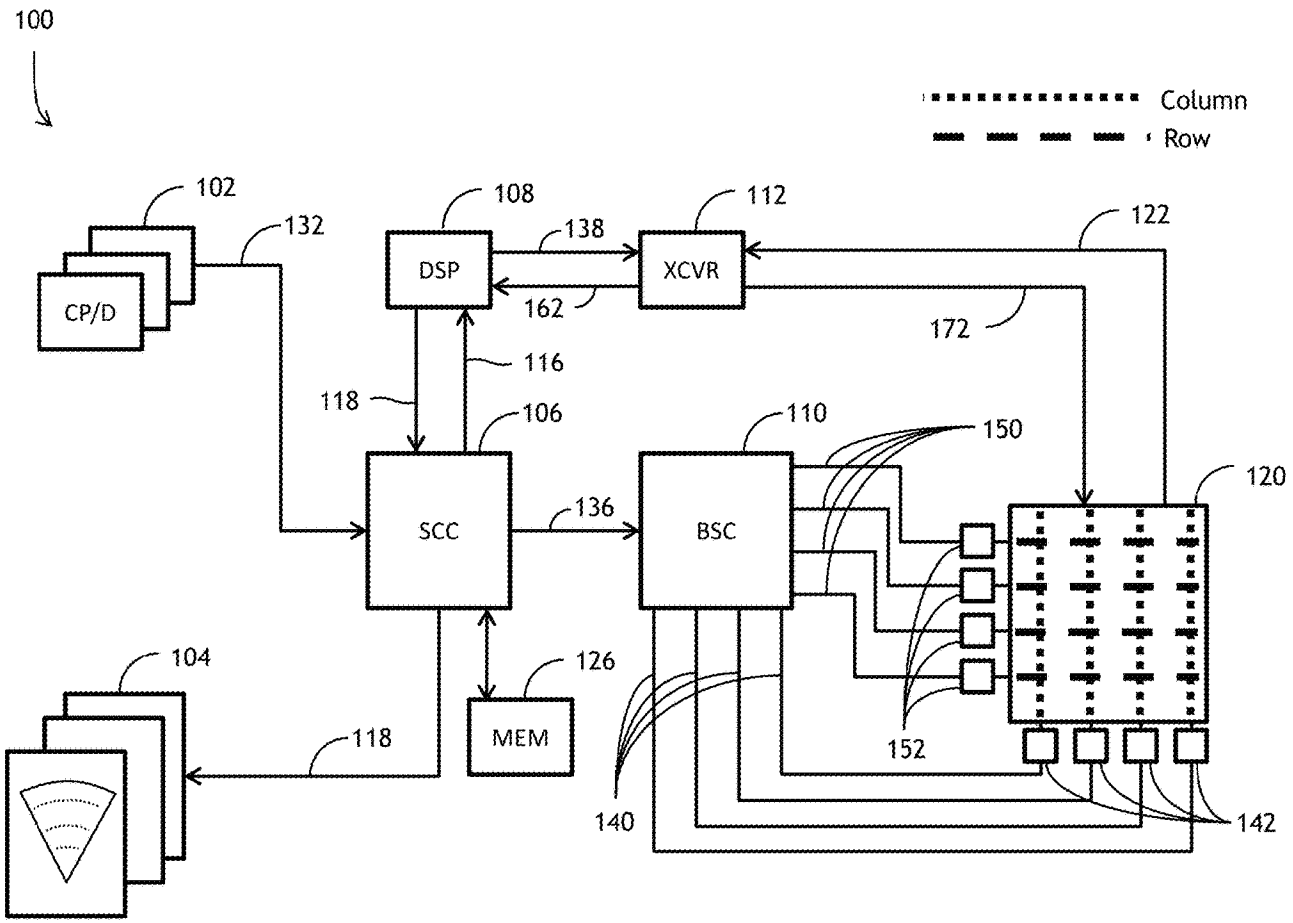
FIG. 1 is a diagram of an exemplary system employing control architecture exemplary of one embodiment of the inventive concepts disclosed herein.

Referring to FIG. 1, a diagram of an exemplary system employing control architecture exemplary of one embodiment of the inventive concepts disclosed herein is shown. The system 100 may indicate a weather radar system operable onboard an aircraft. Although this weather radar embodiment of the inventive concepts disclosed herein may be preferable, a plurality of ESA applications fall directly within the scope of the present invention.

The system 100 may include an ESA 120 for transmission and reception of RF signals. The RF signals may be in the exemplary form of a weather radar signal configured for reflecting from certain types of moisture, an airborne traffic radar signal configured for reflecting from the skin of an aircraft and additional types, and frequencies of RF radar signals for sensing proximal and distant objects and elements.

In the weather radar embodiment exemplified herein, a control panel 102 may receive an array pointing command from an operator. This input may be in the form of a scan, tilt and range information 132 routed to a system control computer 106 for control of the ESA 120 for weather radar applications. A digital signal processor(s) 108 may function to send weather data 118 to the system control computer 106 while the system control computer 106 sends pulse control signals 116 to the digital signal processor(s) 108.

The digital signal processor(s) 108 may send transmit signals 138 to a RF transceiver 112 for transmission by the ESA 120 while RF transceiver 112 may send raw returns 162 to the digital signal processor(s) 108.

The system 100 may route RF receive signals 122 from the ESA 120 to the transceiver 112 while routing RF transmit signals 172 to the ESA 120 from the transceiver 112. In some embodiments, the RF receive signals 122 and the RF transmit signals 172 may be combined into a single bi-directional interface for flexibility in application and architecture. The system control computer 106 may send weather data 118 to a display(s) 104 while also sending array pointing commands 136 to a beam steer computer 110.

The system 100 may route column control data 140 from the beam steer computer 110 via a plurality of column transmission optical interfaces 142 to plurality of optical transmitters (transceivers) within the ESA 120. The system 100 may also route row control data 150 to the optical transmitters (transceivers) on the ESA 120 via plurality of row transmission optical interfaces 152. In this manner, the system 100 may control the ESA 120 through an operator input to the control panels 102 via optical control signals routed to the ESA 120.

Figure 2:
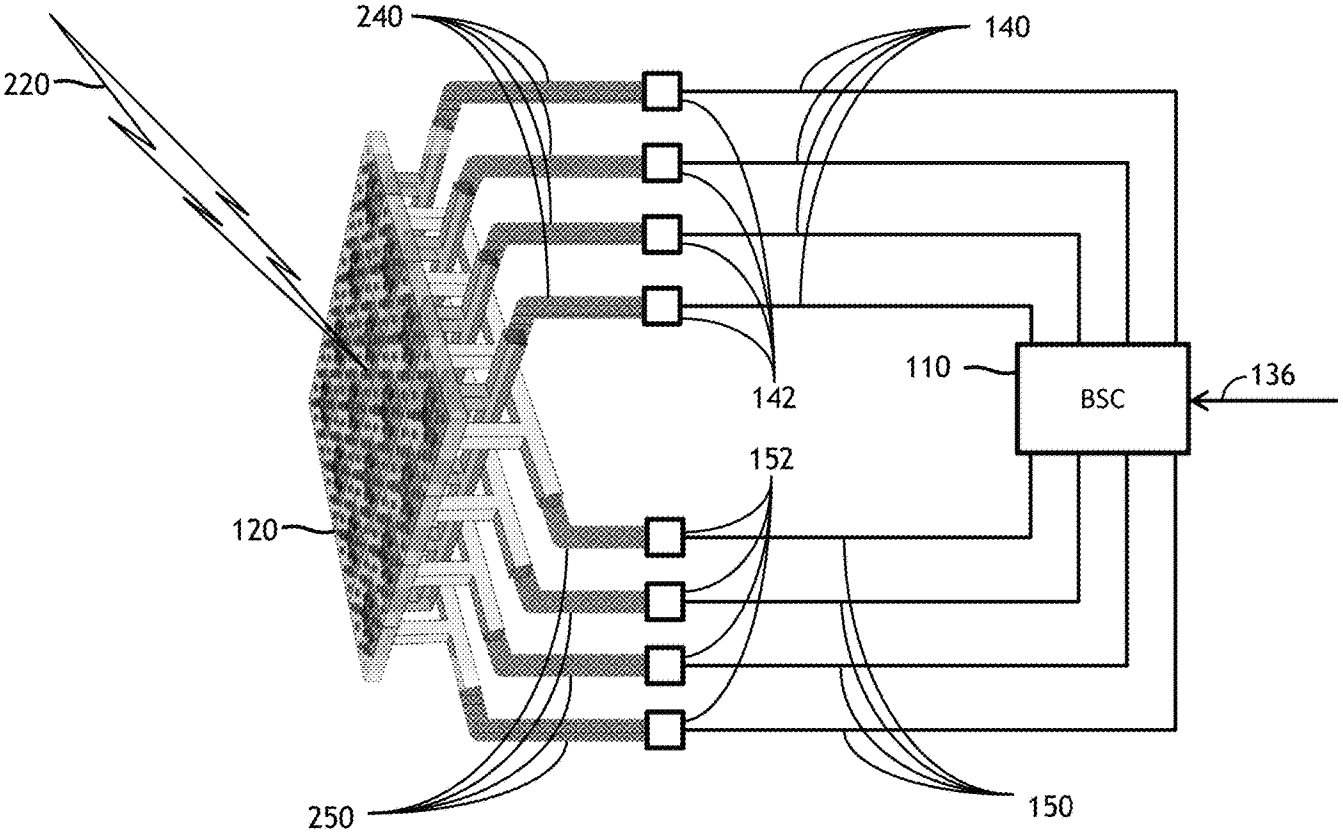
FIG. 2 is a diagram of an exemplary control architecture associated with an embodiment of the inventive concepts disclosed herein.

Referring to FIG. 2, a diagram of an exemplary control architecture associated with an embodiment of the inventive concepts disclosed herein is shown. The ESA 120 may be comprised of a plurality of tiles (further detailed in FIG. 5 below) which house the ESA elements capable of producing the ESA RF beam 220. As used herein, a tile may be defined as a portion of the overall ESA 120. Each tile may include one or more optical interfaces for receiving and/or transmitting/receiving optical signals, a central processor for executing commands required by the system 100 and a plurality of ICs capable of routing commands to individual ESA elements within the ESA 120. A plurality of tiles oriented in columns and rows may comprise the ESA 120. FIG. 2 details the ESA 120 having an exemplary 16 tiles.

The ESA 120 may be controlled via signals transmitted via a plurality of row optical wave guides 250 and a plurality of column optical wave guides 240. Each of the optical wave guides 240 and 250 may receive an optical control signal via an optical transmission interface 142. The optical transmission interface 142 may receive a signal from the beam steering computer 110 and translate the signal from digital to optical for further distribution by the optical wave guides 240 and 250.

Preferably, the beam steer computer 110 may provide a single row signal of row control data 140 to control each of the 16 tiles in the ESA 120. Similarly, the beam steer computer 110 may provide a single column signal of column control data 140 to redundantly control each of the tiles in the ESA 120.

Alternatively, the beam steer computer 110 may provide a single combined control signal capable of being routed through both of the column and row optical wave guides 240 and 250. In this manner, the single combined control signal may offer flexibility to an operator to limit processing requirements within entirety of the system 100 and specifically the beam steer computer 110. Further contemplated within the single combined control signal embodiment, a plurality of wavelengths within the single optical signal may offer a corresponding plurality of data streams available to control each tile and element of the ESA 120. Should an operator be limited in physical space in which to mount the ESA 120, this single combined control signal option may be preferable to a plurality of signals routed by the system 100 via a plurality of optical pathways.

Alternatively, each control data 140 150 signal may be unique and routed by an individual optical wave guide (e.g., 240 or 250) and assigned to a single tile within the ESA 120. This configuration may offer an operator additional redundancy as well as flexibility to operate individual tiles within the ESA as desired.

In some embodiments, multiple optical wave guides (e.g., 240 and 250) may provide a redundant control signal to each tile of the ESA 120. For example, each tile on the ESA 120 may be configured with one or more optical interfaces capable of receiving multiple instances of the same redundant control signal, each of the optical interfaces having a unique and isolated optical wave guide (e.g., 240 or 250) for supplying the control signal.

In some embodiments, a group of elements (and a group of tiles) may be controlled via a single combined control signal distributed to the entire group. For example, a group of elements may be comprised of a row of four tiles with control signals supplied by a single optical wave guide 250 routed to each tile in the group. As each tile may be proximal to the other tiles in the group, a similar control signal may command the desired operation of each tile within the group.

Figure 3:
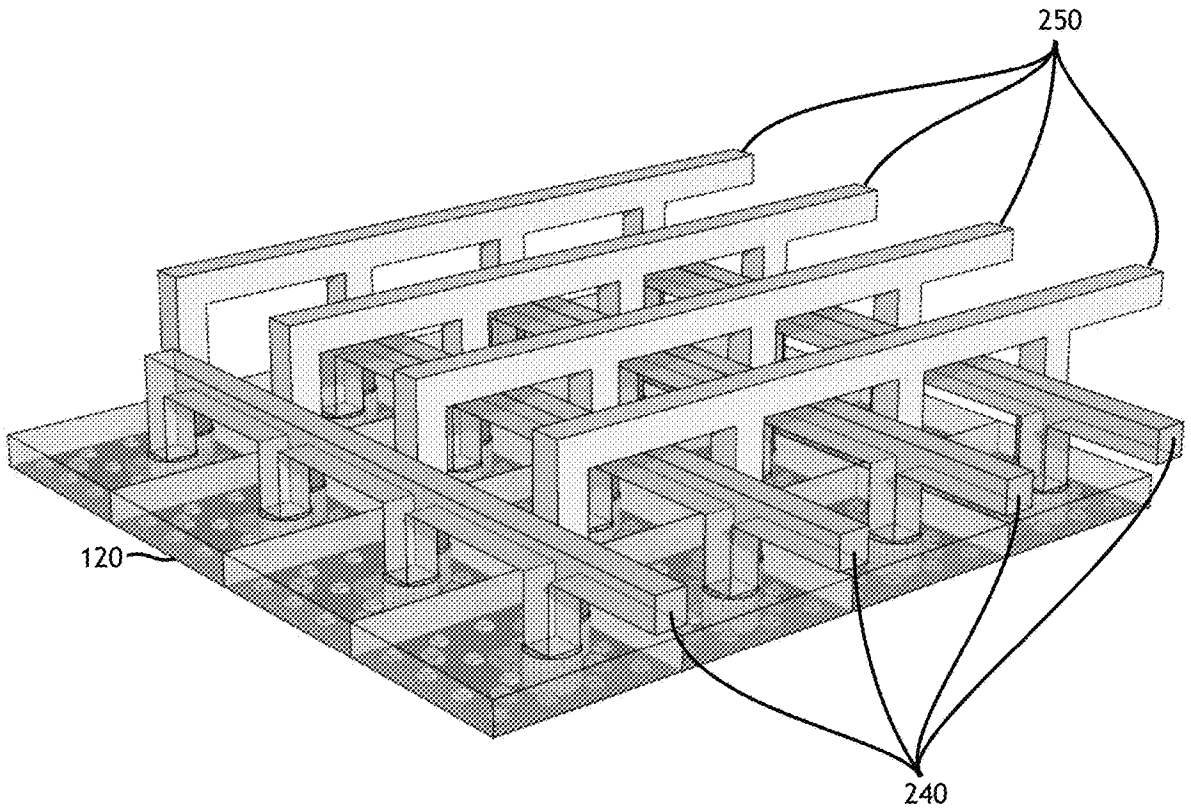
FIG. 3 is a diagram of an exemplary control and operational architecture associated with an embodiment of the inventive concepts disclosed herein.

Referring to FIG. 3, a diagram of an exemplary control and operational architecture associated with an embodiment of the inventive concepts disclosed herein is shown. The ESA 120 may be comprised of an exemplary 16 tiles in four rows of four. The row optical wave guide 250 may supply a first control signal of row control data 150 to each of the 16 tiles while column optical wave guide 240 may supply a second control signal of column control data 140 to each of the exemplary 16 tiles in the ESA 120. In some embodiments, the first control signal and the second control signal are identical.

The column optical wave guide 240 and the row optical waveguide 250 may be preferably constructed of elements capable of minimal loss of the optical transmission signal. In one embodiment, an optical transmissive element similar to telecommunications grade fiber optic interconnects may function within the scope of the inventive concepts disclosed herein. Additional embodiments may employ multi-strand plastic optical fibers or quartz glass optical fibers. Further, embodiments of the inventive concepts disclosed herein may include the employment of precision machined fiber optic cables to efficiently carry the optical signal from point to point.

In some embodiments, multiple (redundant) row, column, diagonal, and/or hopscotch optical wave guides/manifolds may be implemented within the scope of the inventive concepts disclosed herein. The system 100 may operate as an illustrative simplification and indicates an exemplary redundant row and column arrangement. In many cases, tertiary or quad redundancy may be a requirement of a specific operator. Embodiments of the system 100 may be configured for additional redundancy to assure control signals are meeting the redundancy requirements of the operators.

Figure 4:
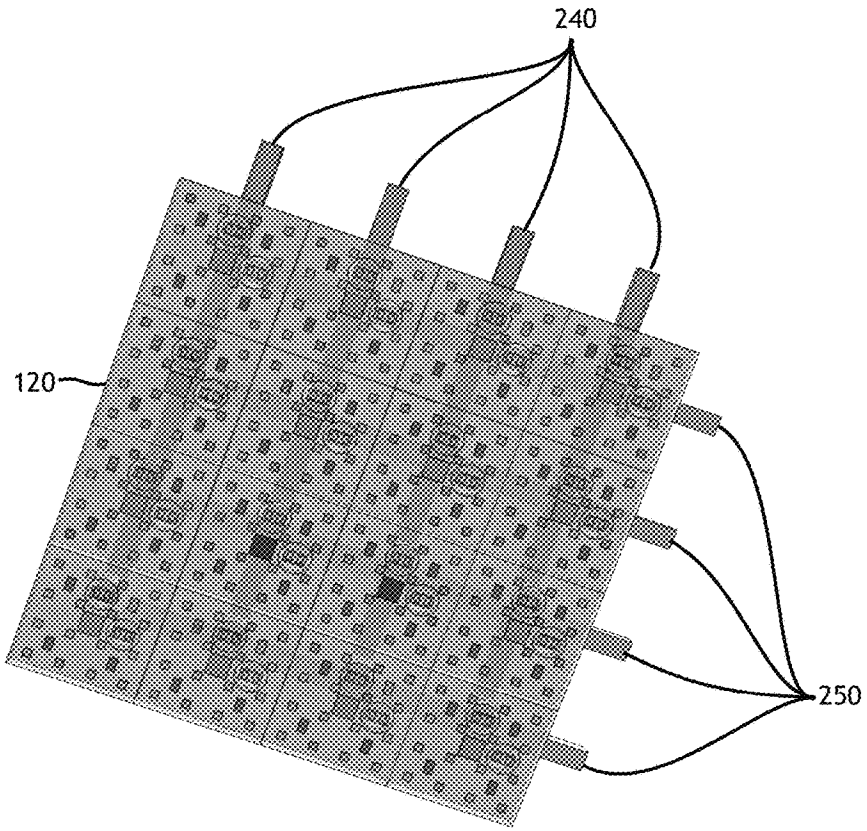
FIG. 4 is an diagram of an ESA exemplary of one embodiment of the inventive concepts disclosed herein.

Referring to FIG. 4, a diagram of an ESA exemplary of one embodiment of the inventive concepts disclosed herein is shown. From this top view, each row optical wave guide 250 and each column optical wave guide 240 may be partially hidden from view by the ESA 120. The exemplary 16 tiles comprising the ESA 120 are clearly seen here as exemplary squarely shaped elements. In some embodiments, ESA element shapes may be in additional forms. For example, a triangular ESA antenna element as well as a trapezoidal ESA antenna element may function within the scope of the inventive concepts disclosed herein.

Figure 5:
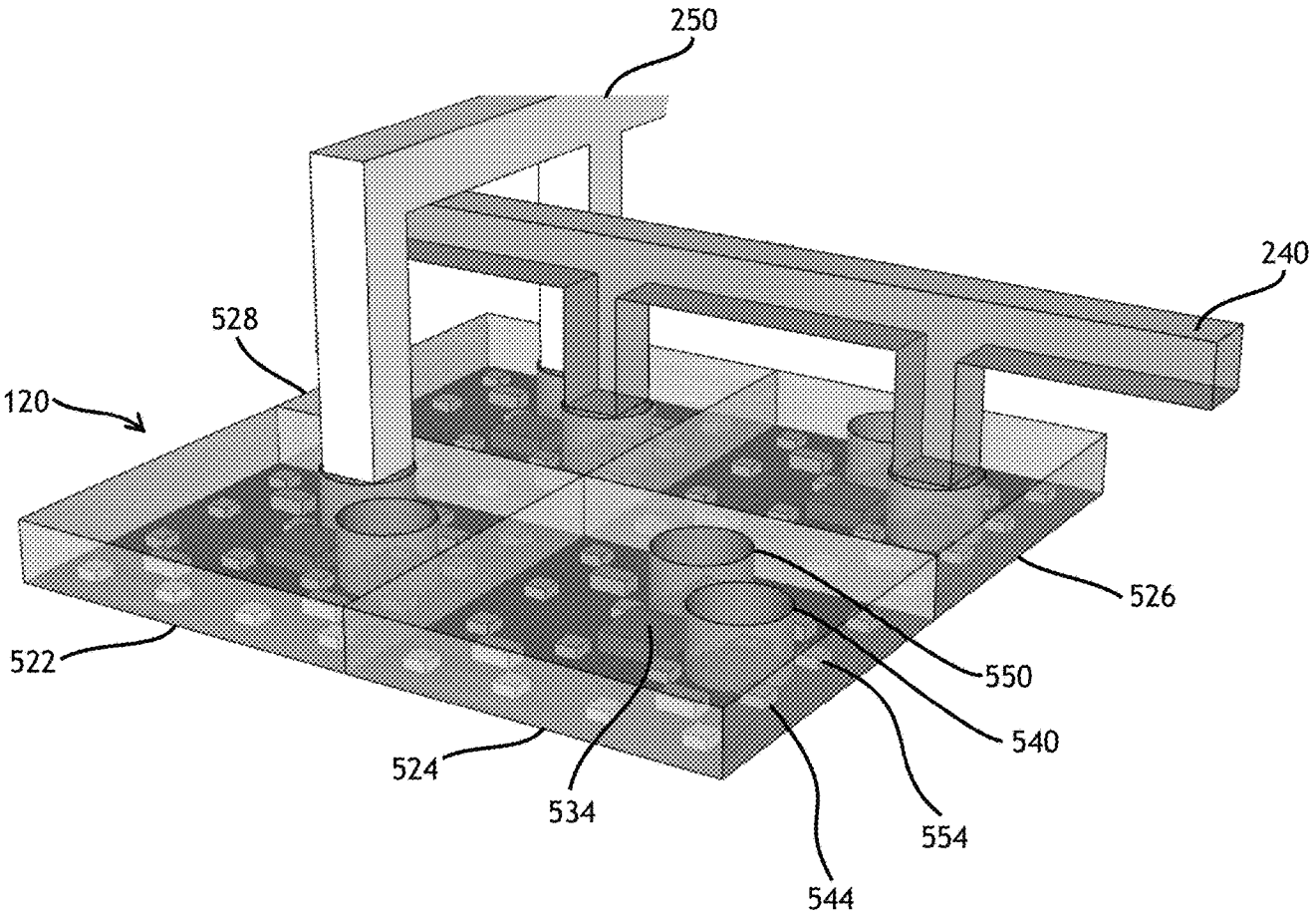
FIG. 5 is a diagram of an exemplary control and operational architecture in accordance with one embodiment of the inventive concepts disclosed herein.

Referring to FIG. 5, a diagram of an exemplary control and operational architecture in accordance with one embodiment of the inventive concepts disclosed herein is shown. A portion of the system 100 is indicated here for clarity. The system 100 may include a first tile 522 maintaining a plurality of ESA elements, a second tile 524, a third tile 526, and a fourth tile 528, each maintaining a central processor 534 and a plurality of ESA elements 544 and 554.

As above, each of the ESA 120 may be exemplary comprised of a PWB having a plurality of tiles 522, 524, 526, and 528 to provide the control and desired characteristics of the RF beam created by the ESA 120. Each of the plurality of tiles 522, 524, 526, and 528 may maintain a group of Integrated Circuits (IC)s within to properly route the signals for the system 100 to control the ESA RF beam 220 as well as data send and data receive signals. RF control ICs, RFICs, Monolithic Microwave ICs (MMIC), power amplifier ICs and transceiver ICs may be mounted to each tile 522 of the PWB for operational employment by the ESA 120. For proper and efficient operation of the ESA 120 within each tile 524, each of the mounted ICs must be addressed individually with control information.

In some embodiments, the optically controlled ESA may be an Active Electronically Scanned Array (ESA) and a Passive Electronically Scanned Array (PESA) antenna. The optical control and operational communication concepts disclosed herein may apply to any type of ESA including AESA, PESA and additional types of ESA antenna elements.

Here, the ESA 120 may be organized into a matrix of tiles where each tile 522, 524, 526 and 528 may have an exemplary four ESA elements and a number of ICs. Within each tile 524, a row ESA optical interface 550 may provide the interface between row optical wave guide 250 and the plurality of ESA elements 544 and 554 of the tile 524. Similarly, the column ESA optical interface 540 may provide the interface between the column optical interface 240 and the ESA elements 544 and 554 of the tile 522. In this manner, column and row ESA optical interfaces 540 and 550 may function as the optical interconnect between each optical wave guide 240 and 250 and the local group of ICs on tile 524 requiring control information. The column and row ESA optical interfaces 540 and 550 may be proximal to and/or attached into the shielding and/or mechanically affixed above the mounting surface of the tile 524 to interact with the integrated circuits.

For simplification, a single row optical wave guide 250 and a single column optical wave guide 240 remain in place in FIG. 5 to indicate spacing and placement of the control signals.

In embodiments, one control message may control more than one element within a group of elements. For a minimum addressable unit, an exemplary productivity of an ESA RF beam 220 of a phase shift of 40 degrees and an attenuation of two dB, one embodiment of the inventive concepts disclosed herein may include a single message burst to send control information for an exemplary four (or eight or greater) individual elements in a group. In this manner, each optical wave guide 240 250 may supply control information to a central processor 534 within each tile 522, 524, 526 and 528. In turn each central processor 534 may supply control information to a multiple number of elements within a group.

Figure 6:
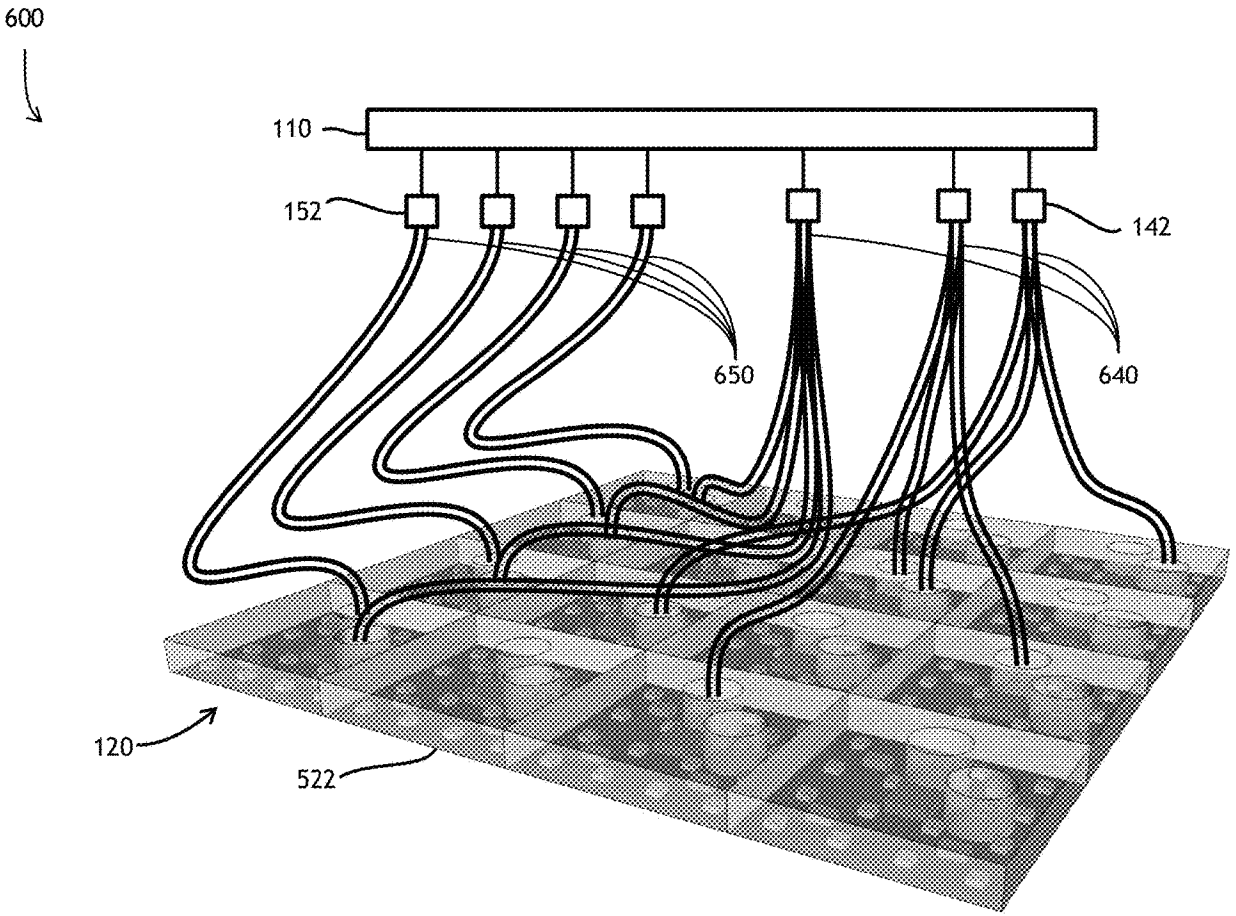
FIG. 6 is a diagram of an exemplary control architecture in accordance with one embodiment of the inventive concepts disclosed herein.

Referring to FIG. 6, a diagram of an exemplary control architecture in accordance with one embodiment of the inventive concepts disclosed herein is shown. Architecture 600 indicates each tile 522 of the ESA 120 may be supplied the optical control signal via a plurality of architectures.

In one embodiment, flexible optical wave guides 640 and 650 may operate to supply each ESA optical interface with the control signal. As above, the beam steer computer 110 may provide the control signal through the transmission optical interfaces 152 and 142 to supply flexible optical wave guides 640 and 650. As above, additional control signal redundancy may be realized by the system 100 through additional rows, columns, diagonally oriented and hopscotch oriented optical wave guides.

Figure 7:
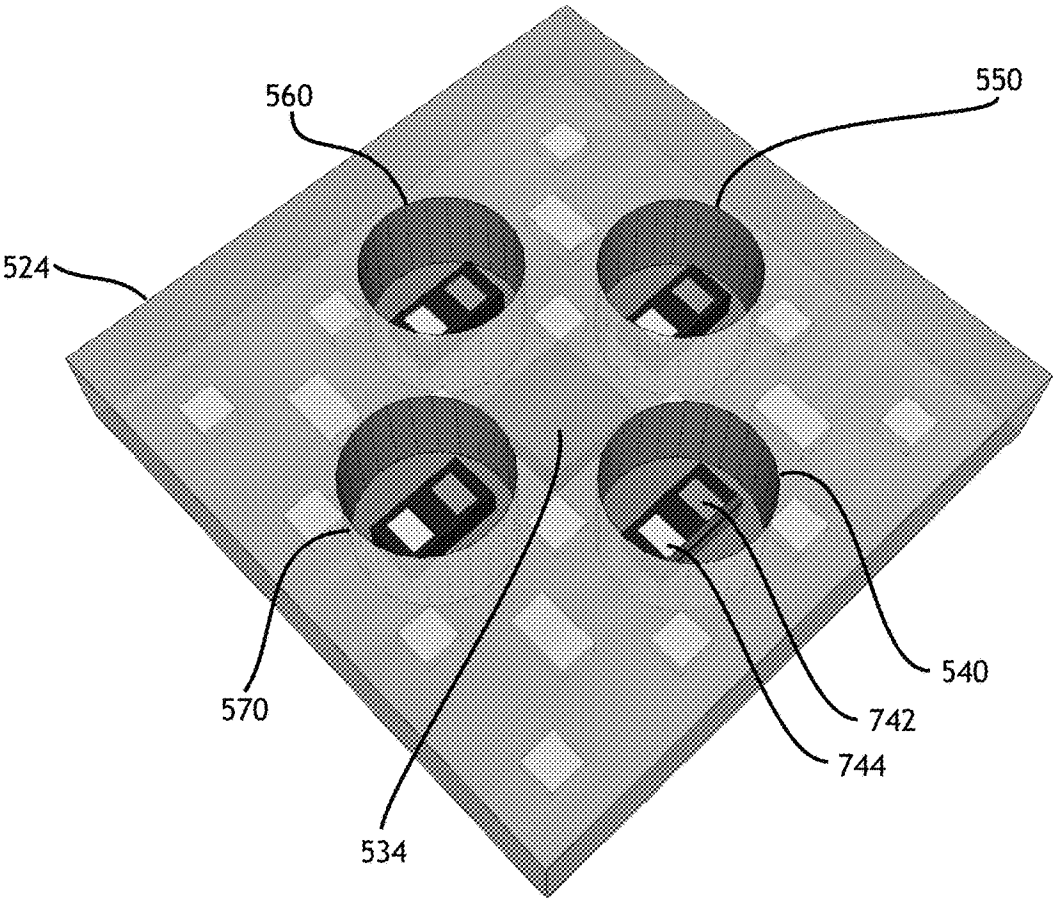
FIG. 7 a diagram of an exemplary optical interface associated with one embodiment of the inventive concepts disclosed herein.

Referring to FIG. 7, a diagram of an exemplary optical interface associated with one embodiment of the inventive concepts disclosed herein is shown. Each of system 100 optical interfaces may provide optical control signals to control each ESA element and thereby control the ESA RF beam 220. In addition, ESA optical interfaces may function to transmit the RF data signal from the ESA elements to the system 100. As a greater number of ESA optical interfaces may equate to greater redundancy of command and RF data signals, the system 100 may employ a plurality of ESA optical interfaces to route the signals.

Each of the column and row ESA optical interfaces 540 and 550 may operate as the interface between the optical wave guides 240 250 and the group of ESA elements requiring control information. Column and row ESA optical interfaces 540 and 550 may include individual optical receivers/transceivers. Where the ESA optical interface 540 is acting as a receiver, an optical receiver may include a photo transistor 742 and associated amplification and filtering circuitry. Where the optical interface 540 is acting in a transceiver mode, the system 100 may employ a Light Emitting Diode (LED) 744 for optical RF data signal transmission.

In one embodiment of the inventive concepts disclosed herein, a triple redundancy may include a row of optical wave guides supplying control to a row of tiles, a column of optical wave guides supplying control to a column of the same tiles and a diagonally aligned set of optical wave guides supplying a third source of the control signal for each tile of the array. In this manner, a triple redundant system may supply a triple copy of the control signal to each tile and ESA element in the ESA 120 array.

In additional embodiments, a quad-redundant system may be employed within the scope of the inventive concepts disclosed herein. Row ESA optical interface 550 may be supplied with a control signal from the row optical wave guide 250, column optical interface 540 may be supplied with a control signal from the column optical wave guide 240, a first diagonal optical wave guide (not pictured) may supply control signal to optical interface 750 and a second diagonal optical wave guide perpendicular to the first diagonal may supply a fourth control signal to optical interface 740.

In the receive embodiment described above, each central processor 534 may operate in a listen-only mode via photo transistor 742 operating to unidirectionally receive the control signal from system control computer 106. In this manner, column and row ESA optical interfaces 540 and 550 may also act in a receive only mode.

In the bi-directional transceiver embodiment described above, each central processor 534 may bi-directionally communicate with the system control computer 106 via a bi-directional optical interface 540 and 550 and bi-directional optical wave guides 240 and 250.

An additional embodiment of the inventive concepts disclosed herein may include a combination of capabilities of the optical interfaces 540. This combination may include column and row ESA optical interfaces 540 and 550 maintaining a receive capability and optical interfaces 560 and 570 maintaining a transceiver capability. In this manner, for example, a quad redundant system may maintain dual receiver redundancy while also maintaining dual transceiver redundancy.

In addition, single capability tiles 524 may be oriented within the structure of ESA 120 to offer additional flexibility and redundancy. For example, multiple receive only tiles 524 and 528 (FIG. 5) may operate alongside a transceiver tile 526 and 522 to provide the ESA 120 additional redundancy options. In this manner, regardless of tile receive/transceiver function, should one tile or element within the tile fail, an exchange of the faulty tile for an operational tile may offer additional maintenance capabilities for ESA 120 operators. The operator may then have the option to repair the faulty element within the faulty tile and return the repaired tile to future operation.

System 100 redundancy may also stem from more than one optical wave guide 240 and 250 supplying control signals to a single optical interface 540. In this manner, the system redundancy lies in the signal transmission medium as opposed to one interface per optical wave guide arrangement as outlined above. In some embodiments, a time shifting of the signals entering the single optical interface 540 or a system 100 employing a first control signal carried on a first frequency and a second control signal carried on a second frequency etc. may function within the scope of the inventive concepts disclosed herein. With a single ESA optical interface 550, an operator may realize a lower power consumption, component cost and complexity due to increased operation required by the central processor 534.

Figure 8:
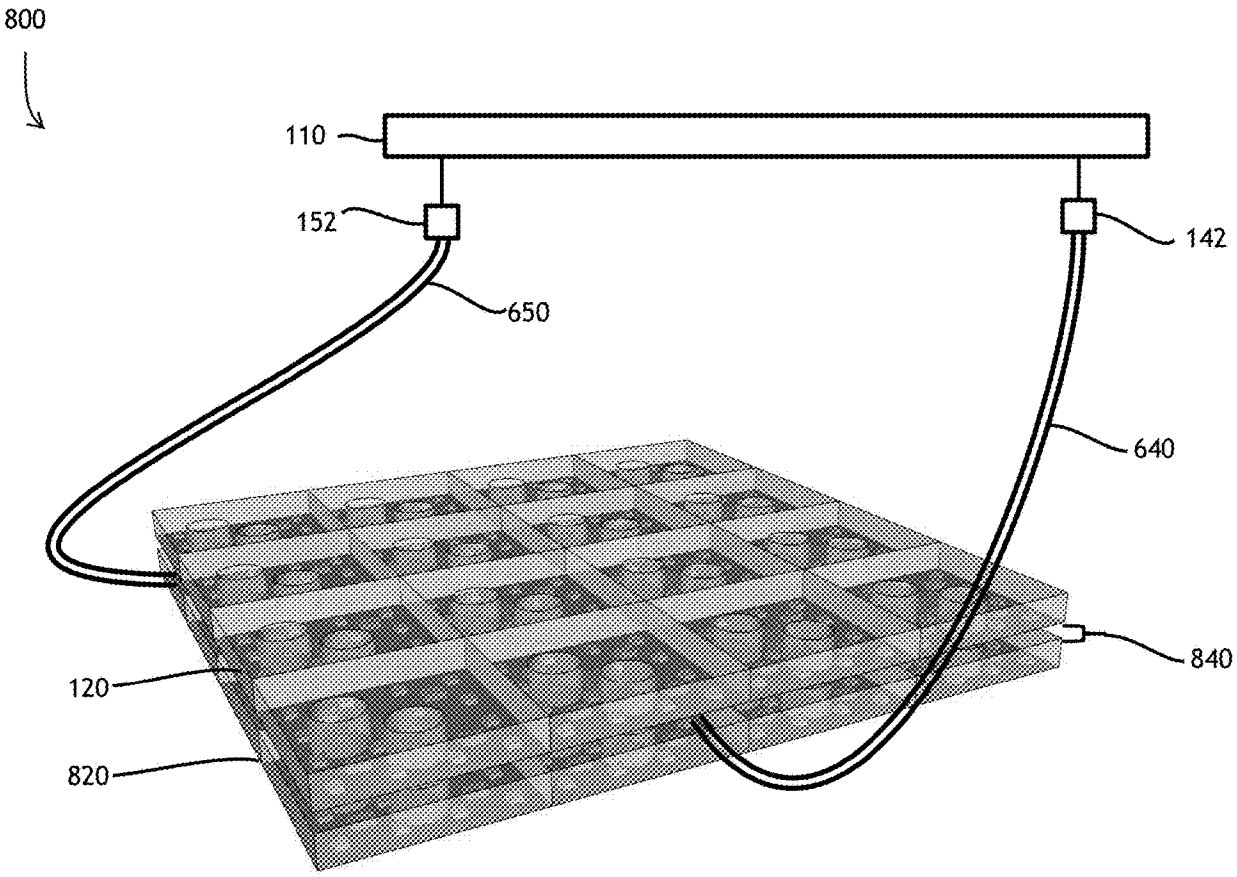
FIG. 8 is a diagram of an exemplary control and operational architecture maintaining a double PWB associated with one embodiment of the inventive concepts disclosed herein.

Referring to FIG. 8, a diagram of an exemplary control and operational architecture maintaining a double PWB associated with one embodiment of the inventive concepts disclosed herein is shown. Architecture 800 indicates a second PWB 820 containing the optical receivers/transmitters/transceivers is preferably mounted adjacent to first PWB associated with the ESA panel 120 with or without an optical waveguide/fiber optic as the optical transmission medium. In one embodiment without and optical wave guide, the optical transmission medium from the transmission interface to each tile may be provided via atmosphere/gas/free cavity 840.

Alternatively, optical waveguides (FIG. 6) may be preferable over free space distribution (FIG. 8) to protect the optical control signal and communication channel against environmental conditions. However, a free space (e.g., cavity) distribution may also function within the scope of the inventive concepts disclosed herein. In embodiments, the second PWB 820 may operate to separate the control signals from the RF signals. As the ESA 120 panel may be an expensive element to reproduce in the event of damage, the less expensive second PWB 820 may provide the control signals while the ESA 120 maintains the RF signals.

By splitting the complexity into two different PWBs the system 100 may offer an increased flexibility to operators to decrease cost. Architecture 800 may allow the system 100 use of optical control rather than electrical control and eliminate expensive electrical connectors between the first PWB of the ESA 120 and the second PWB 820.

Alternatively, the second PWB 820 may provide the optical function and supply control signals to a traditional PWB of the ESA 120. In this architecture, the second PWB 820 may not contain the RF ICs, RF transmission lines or antenna elements. Its sole purpose would be to generate the optical control signal(s) in the proper orientation with respect to the first PWB of the ESA 120.

Figure 9:
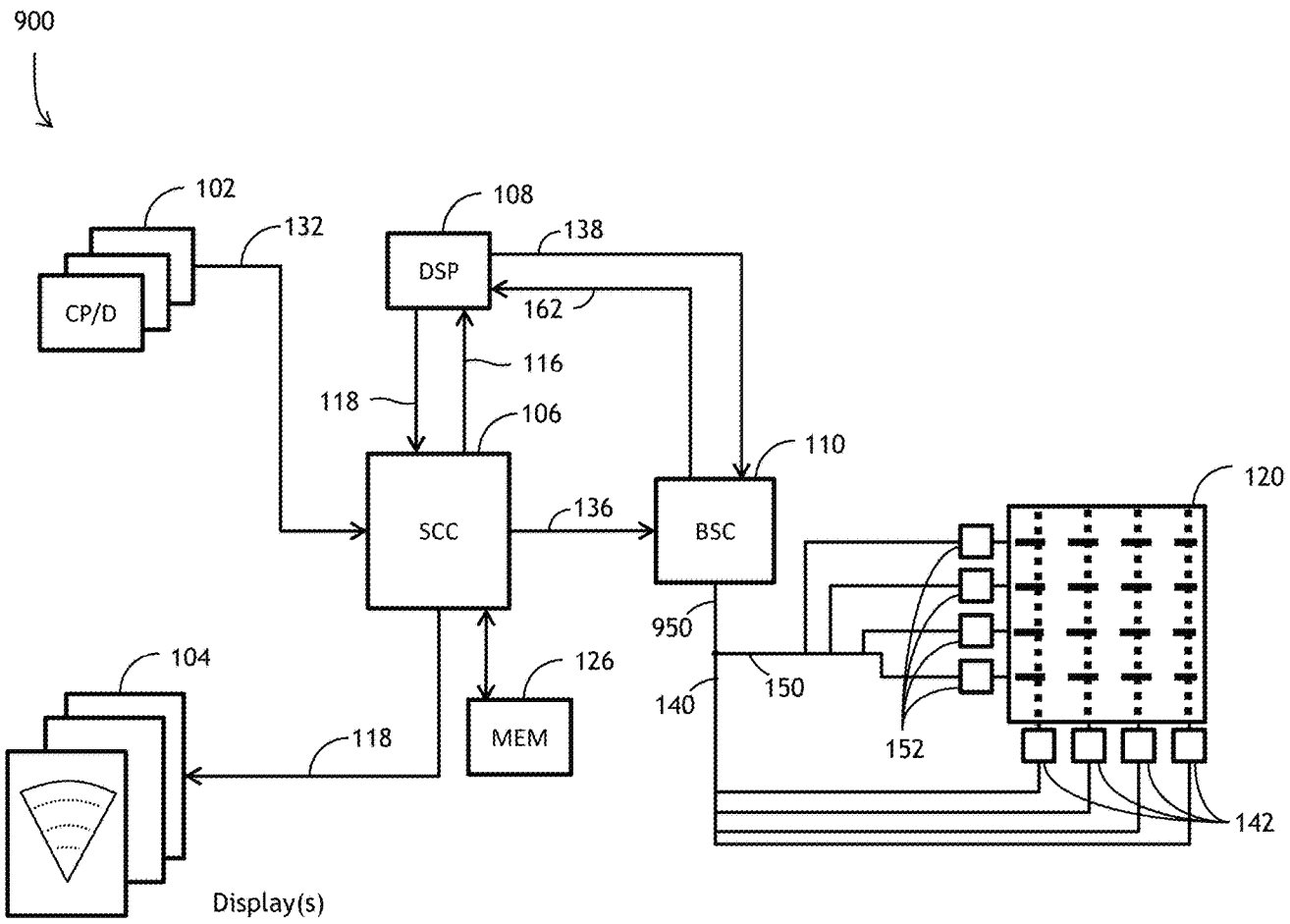
FIG. 9 is a diagram of an alternate control and operational architecture for an ESA exemplary of one embodiment of the inventive concepts disclosed herein.

Referring to FIG. 9, a diagram of an alternate control and operational architecture for an ESA exemplary of one embodiment of the inventive concepts disclosed herein is shown. Architecture 900 outlines an embodiment of the system 100 where optical wave guides provide both the control signal for the ESA 120 and the RF data signal as a product of the ESA 120 antenna. Further a single combined control and operational signal 950 may function to both 1) control the ESA 120 via optical transmission of the control signal, and 2) provide the RF data signal from the ESA 120 to the display 104 via the single optical wave guide.

In the alternate embodiment of FIG. 9, the beam steering computer 110 may communicate directly with the transceiver 112 to enable the beam steering computer 110 to provide the RF transmit signal 172 to the ESA 120. In addition, the beam steering computer 110 functions to receive the RF receive signal 122 from the ESA 120 to return back through the transceiver 112 for eventual display to an operator viewing display 104.

Here, the transmit and receive function of transceiver 112 (FIG. 1) may be distributed into the ESA 120. The BSC 110 may route digital signals converted from optical to and from the DSP 108.

Here, the single combined control and operational signal 950 may function to control as well as send and receive data signals from the ESA 120. In one embodiment, the single combined control and operational signal 950 may include a control channel having a first wavelength and a data channel maintaining a second wavelength to allow the separate data streams to bi-directionally travel within the single optical wave guide.

Figure 10:
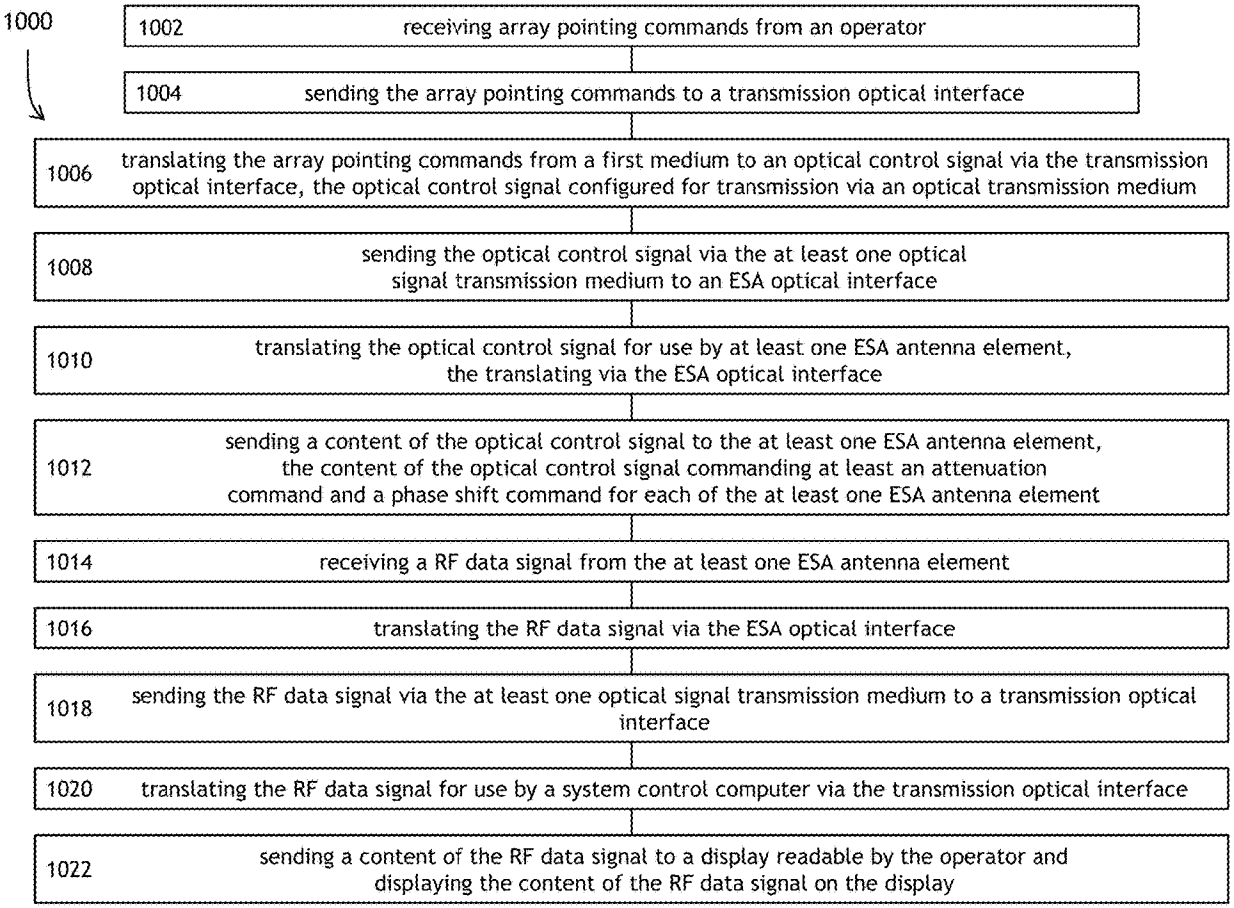
FIG. 10 is a flow diagram of a method for optically controlled ESA exemplary of one embodiment of the inventive concepts disclosed herein.

Referring to FIG. 10, a flow diagram of a method for optically controlled ESA exemplary of one embodiment of the inventive concepts disclosed herein is shown.

Method 1000 may begin at a step 1002 with receiving array pointing commands from an operator, and at a step 1004 sending the array pointing commands to a transmission optical interface. A step 1006 may include translating the array pointing commands from a first medium to an optical control signal via the transmission optical interface, the optical control signal configured for transmission via an optical transmission medium and a step 1008 may include sending the optical control signal via the at least one optical signal transmission medium to an ESA optical interface.

Method 1000 may continue at a step 1010 with translating the optical control signal for use by at least one ESA antenna element, the translating via the ESA optical interface, and at a step 1012 with sending a content of the optical control signal to the at least one ESA antenna element, the content of the optical control signal commanding at least an azimuth and elevation of an ESA beam.

Method 1000 may continue at a step 1014 with receiving a RF data signal from the at least one ESA antenna element, and at a step 1016 with translating the RF data signal via the ESA optical interface. A step 1018 may include sending the RF data signal via the at least one optical signal transmission medium to a transmission optical interface, and a step 1020 may include translating the RF data signal for use by a system control computer via the transmission optical interface. Method 1000 may conclude at a step 1022 with sending a content of the RF data signal to a display readable by the operator.

CONCLUSION

Specific blocks, sections, devices, functions, processes and modules may have been set forth. However, a skilled technologist will realize that there are many ways to partition the system, and that there are many parts, components, processes, modules or functions that may be substituted for those listed above.

Those having skill in the art will recognize that the state of the art has progressed to the point where there may be little distinction left between hardware, software, and/or firmware implementations of aspects of systems; the use of hardware, software, and/or firmware is generally (but not always, in that in certain contexts the choice between hardware and software can become significant) a design choice representing cost vs. efficiency tradeoffs.

Additionally, implementations of embodiments disclosed herein may include executing a special-purpose instruction sequence or invoking circuitry for enabling, triggering, coordinating, requesting, or otherwise causing one or more occurrences of virtually any functional operations described herein.

While particular aspects of the inventive concepts disclosed herein have been shown and described, it will be apparent to those skilled in the art that, based upon the teachings herein, changes and modifications may be made without departing from the inventive concepts described herein and their broader aspects and, therefore, the appended claims are to encompass within their scope all such changes and modifications as are within the true spirit and scope of the subject matter described herein.

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently.

What is claimed is:

1. A system for optical control of an electronically scanned array (ESA) antenna, comprising:

an ESA optical interface associated with at least one ESA antenna element, the ESA optical interface having at least one optical transceiver configured for:

receiving an optical control signal;

translating the optical control signal for use by the at least one ESA antenna element; and transmitting a data signal received from the at least one ESA antenna element;

a row optical wave guide and a column optical wave guide in proximity with each other, the column optical wave guide perpendicular to the row optical wave guide, each of the column optical wave guide and the and row optical wave guide deliver the optical control signal to the at least one ESA antenna element;

a transmission optical interface associated with a source of the optical control signal, the transmission optical interface configured for:

receiving array pointing commands;

translating the array pointing commands from a first medium to the optical control signal, the optical control signal configured for transmission via the row optical wave guide and the column optical wave guide;

sending the optical control signal via the row optical wave guide and the column optical wave guide to the ESA optical interface;

receiving the data signal from the at least one ESA antenna element via the ESA optical interface through the row optical wave guide and the column optical wave guide;

a system control computer device;

a memory associated with the system control computer device, the memory having non-transitory computer readable program code embodied therein, the non-transitory computer readable program code comprising commands which, when executed by the system control computer device, cause the system control computer device to:

receive the array pointing commands from the operator;

send the array pointing commands to the transmission optical interface;

receive the data signal from the transmission optical interface; and display a content of the data signal on a display.

2. The system of claim 1, wherein the source of the optical control signal is a beam steering computer associated with one of: a weather radar system, a radio communication system, and a radio surveillance system.

3. The system of claim 1, wherein each of the transmission optical interface and the ESA optical interface is further configured for a bi-directional optical data transfer between the at least one ESA antenna element and the system control computer device via the optical signal transmission medium.

4. The system of claim 1, wherein the transmission optical interface is further configured for translating the array pointing commands into a plurality of signal control parameters, the plurality of signal control parameters including at least amplification, attenuation and phase shift, for each of the at least one ESA antenna elements.

5. The system of claim 1, wherein the at least one optical transceiver further comprises at least one of: a light emitting diode, a laser diode, a laser, a photo transistor, photo resistor and an optical receiver.

6. The system of claim 1, wherein the optical control signal further includes attenuation commands, phase shift commands and power control commands for each of the at least one ESA antenna element.

7. The system of claim 1, further including a dual printed wiring board assembly associated with the at least one ESA antenna element, the optical signal transmission medium associated with the dual printed wiring board assembly includes a gaseous cavity between a first printed wiring board and a second printed wiring board comprising the dual printed wiring board assembly.

8. The system of claim 1, wherein the data signal further includes one of: raw radar returns associated with a desired radar reflective target and a signal associated with a distant radio communication transmitter.

* * * * *